US010174497B2

(12) United States Patent
Perez-Romero et al.

(10) Patent No.: US 10,174,497 B2
(45) Date of Patent: Jan. 8, 2019

(54) PREFABRICATED CONSTRUCTION SYSTEM AND METHOD WITH THREE-DIMENSIONAL STRUCTURAL NODES

(71) Applicants: Manuel Perez-Romero, Madrid (ES); Jaime Tarazona-Lizarraga, Madrid (ES)

(72) Inventors: Manuel Perez-Romero, Madrid (ES); Jaime Tarazona-Lizarraga, Madrid (ES)

( * ) Notice: Subject to any disclaimer, the term of this patent is extended or adjusted under 35 U.S.C. 154(b) by 0 days.

(21) Appl. No.: 15/536,966

(22) PCT Filed: Dec. 16, 2015

(86) PCT No.: PCT/ES2015/070918
§ 371 (c)(1),
(2) Date: Jun. 16, 2017

(87) PCT Pub. No.: WO2016/097452
PCT Pub. Date: Jun. 23, 2016

(65) Prior Publication Data

US 2017/0370090 A1 Dec. 28, 2017

(30) Foreign Application Priority Data

Dec. 16, 2014 (ES) ..... 201431842

(51) Int. Cl.
*E04B 1/26* (2006.01)
*E04B 1/19* (2006.01)

(52) U.S. Cl.
CPC .... *E04B 1/2604* (2013.01); *E04B 2001/1975* (2013.01); *E04B 2001/1993* (2013.01);
(Continued)

(58) Field of Classification Search
CPC ..... Y10T 403/447; Y10T 403/341; Y10T 403/44; Y10T 403/55; A63F 9/12; E04B 1/2604
See application file for complete search history.

(56) References Cited

U.S. PATENT DOCUMENTS 1,066,212 A * 7/1913 Meltzer ..... E04B 1/3483 403/217
1,225,760 A * 5/1917 Brown ..... A63F 9/12 273/160

(Continued)

FOREIGN PATENT DOCUMENTS

FR 2219674 A7 9/1974

*Primary Examiner* — Brian D Mattei
*Assistant Examiner* — Daniel J Kenny
(74) *Attorney, Agent, or Firm* — Eugenio J. Torres-Oyola; Victor M. Rodriguez-Reyes; Rafael Rodriguez-Muriel

(57) ABSTRACT

The present invention relates to a prefabricated construction system and method, for erecting constructions by means of the assembly of prefabricated structural elements obtained by cutting flat materials, forming structural nodes by means of coupling at least a first coupling configuration formed by first slots made in a plurality of parallel boards forming a first structural element with at least a second coupling configuration formed by second slots made in a plurality of parallel boards forming a second structural element, providing a structural core in the form of an array having interstitial openings going through it which allow the coupling of third and fourth coupling configurations of third and fourth structural elements.

12 Claims, 7 Drawing Sheets

(52) U.S. Cl.
CPC . *E04B 2001/262* (2013.01); *E04B 2001/2672* (2013.01); *E04B 2001/2676* (2013.01); *E04B 2103/04* (2013.01)

(56) References Cited

U.S. PATENT DOCUMENTS 1,425,107 A * 8/1922 Levinson ..... A63F 9/12 273/160
1,763,748 A * 6/1930 Best ..... F16B 12/48 211/196
2,712,199 A * 7/1955 Latimer ..... A63H 33/084 403/217
3,387,868 A * 6/1968 Borden ..... F16B 12/40 403/217
3,779,657 A * 12/1973 Kostick ..... F16B 7/0493 403/217
3,866,371 A * 2/1975 Falconer ..... E04B 1/185 52/281
3,966,337 A * 6/1976 Crawford ..... F16B 12/02 312/257.1
4,360,287 A * 11/1982 Larsson ..... A47B 47/04 217/65
4,445,801 A * 5/1984 Trudeau ..... A63H 33/10 403/219
4,540,308 A * 9/1985 Colby ..... F16B 12/00 211/189
5,185,982 A 2/1993 Hostetler
5,650,210 A 7/1997 Fujii
5,813,737 A 9/1998 Stone
D745,703 S * 12/2015 Ivanov ..... D25/61

* cited by examiner

PREFABRICATED CONSTRUCTION SYSTEM AND METHOD WITH THREE-DIMENSIONAL STRUCTURAL NODES

TECHNICAL FIELD

The present invention relates to a prefabricated construction system and method with three-dimensional structural nodes, for erecting constructions by means of the assembly of prefabricated structural elements obtained by cutting flat materials, such as, for example, boards or planks of wood or of a product derived from wood.

PRIOR ART

Prefabricated construction systems with three-dimensional structural nodes are known; for example patent document U.S. Pat. No. 5,650,210 discloses a system according to which a plurality of structural elements such girders and columns can be attached to one another forming a three-dimensional structural node, each of these structural elements being provided with slots, but in this example, said slots are provided for the insertion therethrough of metal fittings, which are responsible for assuring the correct transmission of the loads in said node. In this example, there is no direct interaction between the slots of the different structural elements.

Patent document U.S. Pat. No. 5,185,982 describes the attachment of three boards, each provided with a slot at the head thereof, by means of mutual interaction and coupling, forming a three-dimensional node, but in this case one of the elements arranged horizontally must be placed with the main faces thereof having a larger surface parallel to the ground, thereby providing very low inertia and therefore little structural resistance.

Patent documents U.S. Pat. No. 3,966,337 and U.S. Pat. No. 5,813,737, which refer to furniture and not construction systems for buildings, with all the differences this entails, show the mutual attachment of two boards, arranged horizontally and with the main faces thereof having a larger surface in the vertical direction, thereby providing greater structural resistance, said attachment being obtained by means of respective mutually coupleable slots. The attachment of said two boards can in turn be coupled to a vertical element, in turn provided with slots, recesses and gaps between struts. This configuration is far from being like the proposed configuration, since the lower resistance requirements of furniture allow the configuration proposed by these patent documents to be sufficient, but this configuration cannot be taken literally to the building construction site because the structural resistance requirements are much greater.

Finally document FR2219674 describe an assembly system in which different elongated elements are coupled each other by a projections and recesses configuration, but each elongated element being two separated elements spaced and connected through a spacer, and the coupling configuration being a single recess on each element.

As will be seen below, the described proposal proposes that each of the structural elements is made up of a plurality of boards arranged parallel to one another, thereby increasing the resistance thereof, but making the anchoring of said plurality of elements somewhat more complicated and the solution to this problem is not obvious in view of the mentioned prior art documents.

BRIEF DESCRIPTION OF THE INVENTION

The present invention relates to a prefabricated construction system with three-dimensional structural nodes.

The described construction system consists of a set of elements that can be manufactured in a factory or workshop, in the amount, shape and number suitable for the construction to be performed, previously designed by means of a construction project.

Said elements will be produced preferably from wood, or from products derived from wood, such as, for example, plywood, agglomerated wood, resins, resins and paper, although other materials such as plastics or metals are also acceptable. These materials are resistant, easy to cut, lightweight and have other qualities, such as being recyclable; they are therefore optimal materials for this use.

These prefabricated elements are then transported to the construction site, where they are assembled for erecting a self-supporting structure, by means of the formation of three-dimensional structural nodes formed by the attachment of at least two structural elements. The obtained structure can subsequently be covered by means of enclosure panels, likewise prefabricated and forming part of the construction system, thereby obtaining the projected construction in a completely prefabricated manner by means of standardized dry construction techniques.

Therefore the proposed system consists, in manner that is already known in the prior art, of the following elements:

- a first elongated structural element, arranged with the longer edges thereof being horizontal or with an inclination of ±45° with respect to the horizontal in assembled configuration, and provided with at least a first coupling configuration in at least a lower half or an upper half of said first structural element;
- a second elongated structural element, arranged with the longer edges thereof being horizontal or with an inclination of ±45° with respect to the horizontal in assembled configuration, and provided with at least a second coupling configuration in at least a lower half or an upper half of said second structural element opposite the half where the first coupling configuration is housed, said second coupling configuration in the assembly position being coupled to said first coupling configuration of the first structural element;

the first and second structural elements being non-parallel, and the coupling of the respective coupling configurations of said first, second and third structural elements forming a resistant structural node; and the structural elements in the assembled configuration forming a frame on which a vertical and an horizontal enclosures are fixed.

The first and second structural elements will act as girders, as tie beams, as cross members, or as other structural elements, according to their location in the set of the structure, their position being able to be horizontal, or with a certain inclination in the event of being part of the structure of a pitched roof, or of a stairway or ramp.

The first structural element is not parallel with respect to the second structural element, preferably being perpendicular and each structural element will be provided with at least one coupling configuration, the first and second coupling configurations being complementary to one another, being able to be mutually attached by fixing the relative position of the first and second structural element.

The first coupling configuration will be located in the lower half of the first structural element, and the second coupling configuration will be located in the upper half of the second structural element, but the reverse configuration in which the coupling configuration of the first structural element is located in the upper half, whereas the second coupling configuration is located in the lower half of the second structural element, is also acceptable.

The proposed invention differs from the known techniques by also including the following distinctive features:

- the first and second structural elements are each formed by at least a plurality of parallel and spaced boards, each board is flat and elongated and has at least two parallel front faces, which are those having the larger surface, two head faces at the ends thereof farthest from one another, and two side faces, said faces defining edges, each board being a single board or a group of single boards arranged with the front faces thereof being adjacent, matching and in contact;
- the boards forming the first and second structural elements are arranged in the assembly position with the front faces thereof in the vertical position arranged parallel to, facing and spaced from one another.

Therefore, each structural element is actually an element made up of a plurality of boards arranged with the larger faces thereof in the vertical direction. This position of each board is what provides greater inertia, and therefore greater structural resistance.

Between at least some of the boards forming one and the same structural element there are provided separations leaving a distance between said boards, such that said structural element can be at least partially broken down due to the existence of the separation between its elements. In an alternative embodiment it is envisaged that in said separations there are arranged connectors which allow covering said distance, providing continuity or unity to said structural element. Those boards of one and the same structural element that are not separated from to one another will form a group of boards.

Both the boards forming a structural element and the boards forming a group of boards can be attached to one another, or they may not be attached to one another, their relative position being fixed by the three-dimensional structural nodes.

Other distinctive features of the solution proposed are the following:

- the first coupling configuration has a plurality of first straight slots, defining first projections, said first slots being made from a side face of the first structural element to at least a fifth of the width of the front faces of said first structural element;
- the second coupling configuration has a plurality of second straight slots, defining second projections, said second slots being complementary to the first slots and being made from a side face of the second structural element to at least a fifth of the width of the front faces of the second structural element;

The coupling of the first structural element and the second structural element forms a structural node in the form of an array leaving free interstitial openings. Said interstitial openings can serve for the connection of additional structural elements, as will be described below, or to allow passage through said structural core of installation ducts, such as, for example, ducts for wiring or plumbing, when said additional structural elements do not exist.

The first and second coupling configurations are each formed by a plurality of slots made in the corresponding structural elements. Since each structural element is formed by a plurality of boards, each slot covers all the boards forming said structural element, each board having a portion of the slot such that, when all the boards are placed in the assembled configuration, the slot portions are aligned and form the slot. The high degree of precision required in the board cutting operations to achieve the correct alignment of said slot portions make it advisable to use cutting and automatic or robotized routing techniques, as described below.

The angle formed by the slots of the first and second structural elements with respect to the front faces thereof will be identical, and equal to the existing angle, in the assembled configuration, between the first and second structural elements, because it is the fitting between the first and second anchoring configuration that defines the angle between the first and second structural elements.

Likewise, the angle formed by the slots of the first structural element with respect to the side faces thereof will be equal to the angle of inclination of said first structural element with respect to the vertical in the assembled configuration. The same occurs between the slots of the second anchoring configuration and the second structural element.

Projections are defined between the slots of one and the same coupling configuration, which projections are the material remaining between two spaced slots. The tight insertion of said first slots of the first structural element in the second slots of the second structural element produces an attachment between both elements, and at least a partial intersection thereof, achieving a very rigid node.

The coupling of the first structural element, formed by a plurality of spaced boards or groups of boards, with the second structural element, likewise formed by a plurality of spaced boards or groups of boards, by means of said mutual insertion of the first and second slots, form in the intersection thereof a structural node in the form of an array, in which the intersection between the boards or groups of boards of the first and second structural elements is where the first and second slots of both elements are attached, and the intersection of the separations existing between the boards or groups of boards of the first and second structural elements define hollow interstitial openings. Said interstitial openings will have, in the assembled configuration, a vertical direction, and a quadrangular section, which will be square if the first and second structural elements are perpendicular, and rhombus-shaped if they are not.

The first and second structural elements can have the corresponding first and second coupling configurations at the ends thereof, or have them in an intermediate position, said structural elements then being elements passing therethrough, having a portion on each side of the structural node.

In order to achieve the correct mutual tight insertion between the first and second slots, the first and second coupling configurations preferably have at least one of the following features, and preferably all of them:

- the number of first slots of the first coupling configuration is equal to the number of boards or groups of boards of the second structural element;
- the number of second slots of the second coupling configuration is equal to the number of boards or groups of boards of the first structural element;
- the width of the first slots is equal to the thickness of the boards of the second structural element;
- the width of the second slots is equal to the thickness of the boards of the first structural element;

the first projections have a width equal to the separation distance between the boards of the second structural element;

the second projections have a width equal to the separation distance between the boards of the first structural element;

Additionally, the construction system can also include a third structural vertical element, performing the functions of column, strut, as an element forming part of a structural wall, or of other structural vertical elements, according to their location in the set of the structure. Said third structural element will also be attached to the mentioned structural node.

Therefore:

the third structural element is formed by at least a plurality of parallel and spaced boards, like the boards and groups of boards of the first and second structural elements;

the third elongated structural element, is arranged in the assembled configuration with the longer edges thereof being vertical, and is provided with at least a third coupling configuration in at least one of the ends thereof, and said third coupling configuration in the assembly position being coupled to the structural node formed by the coupling of the first and second coupling configurations;

the third coupling configuration has a plurality of third straight slots, defining third projections, said third slots being made from the head of the third structural element to a depth of at least a fifth of the width of the front faces of the first structural element, said third projections in the assembled configuration being inserted into said interstitial openings.

The third structural element is also formed by a plurality of boards or of groups of boards spaced from one another and has third slots made at the head thereof, leaving there between third projections having a size equal to or less than said interstitial openings. This configuration allows the third projections of each board or group of boards forming the third coupling configuration to be inserted into the interstitial openings, the third structural element thereby being attached to the first and second structural elements, forming the three-dimensional structural node. In order to achieve said insertion, the shape and size of said third projections must be complementary to the shape and size of said interstitial openings.

Preferably, the third coupling configuration of the third structural element has at least one of the following features:

the third coupling configuration has a number of slots equal to the number of boards or groups of boards of the first or second structural element.

the width of the third slots is equal to the thickness of the boards of the first or second structural element.

the third projections have a width equal to the separation distance between the boards of the first or second structural element.

A system that simultaneously has all these features and the previously mentioned features would provide a structural node which, in the assembled configuration, has no hollow spaces or clearances therein, and would therefore also provide a rigid attachment between its elements, preventing any movement or play between its parts.

Optionally, the construction system can include a fourth structural element with features identical to those of the third structural element, being provided with fourth slots and fourth projections, said fourth structural element being able to be inserted into the mentioned interstitial openings of the structural node from a face opposite the face of insertion of the third structural element, the third and fourth structural elements then facing one another at their respective heads and aligned, and their respective boards or groups of boards being vertically aligned or misaligned.

This fourth structural element allows making structures several stories high, as well as suspended floors and lofts.

Like the third coupling configuration, the fourth coupling configuration will preferably include at least one of the following features:

the fourth coupling configuration has a number of slots equal to the number of boards or groups of boards of the first or second structural element;

the width of the fourth slots is equal to the thickness of the boards of the first or second structural element;

the fourth projections have a width equal to the separation distance between the boards of the first or second structural element.

It is understood that the first and second structural elements can each have one or several coupling configurations both at the ends thereof and in intermediate positions, and that the third structural element can have coupling configurations in one or both of the ends thereof.

Preferably the first and second structural elements will be, in the coupling position, flush along the upper face thereof, thereby providing a support plane on which the ground is installed.

Due to the constitution of the proposed system, the boards or groups of boards of the third and optionally of the fourth structural element are inserted into the separation spaces existing between the boards or groups of boards of the first or second structural element. As a result, and to prevent eccentricities in the transmission of the loads from the first or second structural elements to the third structural element, said third and fourth structural element should be made up of a number of boards or of groups of boards equal to the number of boards forming the first or second structural element plus one or minus one, thus being the structural node symmetrical.

In an alternative manner or in a manner complementary to the preceding embodiments, it is contemplated that the first or second structural elements, the boards of which are not parallel to the boards of the third structural element, has a plurality of straight notches arranged in a side face of the boards, said notches being made in a side face opposite the side face containing the mentioned first or second projections and vertically aligned with said first and second projections, or made at the ends of the first or second projections of the first or second structural element, said notches being complementary to the third slots or fourth slots. These notches allow being coupled to the third slots, thus improving the attachment of the third structural element to the rest of the structural node.

The mentioned notches can also include at least one of the following features:

the number of notches is equal to the number of boards of the third or fourth structural element;

the thickness of the notches is equal to the thickness of the boards of the third or fourth structural element;

the separation between the notches is equal to the separation distance between the boards of the third or fourth structural element.

In order to achieve a precise fitting of all the boards forming the proposed system, an automated and robotized manufacture of said boards by means of a cutting system with numerical control, controlled by a computer system which has been provided with all the dimensions of all the unitary elements making up the structural system, is preferably required. Based on said information, the automated cutting system can obtain the necessary boards, each with its coupling configurations, from planks or sheets of raw material, from which all the boards are cut out.

During the cutting process, the automated cutting system can also engrave information on the surface of the boards in reference to their position in the structure, the order of the mounting thereof, the boards with which they are to be attached, or even cuts, guide holes can be made or information engraved in reference to other non-structural elements forming part of a construction, such as electrical ducts, switches, sockets, railings, doors, windows, etc.

Therefore, the present structural system also has aspects that are not known in the prior art in the manufacturing process thereof because even though the following steps of the process are already known:

- generating a computer model of all the boards required, forming the construction system;
- cutting said boards from flat planks by means of an automated cutting system controlled by numerical control;
- transporting said already cut boards to the construction site;
- assembling the boards;

other exclusive features of the present invention are included in this method:

- the computer model includes at least first and second coupling configurations complementary to one another, each provided with a plurality of first and second slots made in the boards; and
- the automated cutting system makes the slots in the boards it cuts.

Likewise, the automated cutting system includes, during cutting tasks of each board, information in reference to the position and/or placement thereof, and/or information in reference to the position and/or placement of other construction elements with respect to said board.

Furthermore, the proposed construction method is characterized in that the computer model decides on the order of cutting the parts depending on at least one of the following variables:

- the thickness of the board to be cut;
- the position of the board in the final construction;
- the order in which each board must be coupled to the rest;
- the order in which each board must be transported to the construction site;
- the size of the board.

This allows optimizing both the material during production, and the storage and transport logistics, as well as the on-site assembly process by manufacturing and transporting the elements to the site in the order of assembly.

In addition to the anchoring configurations, other fixing systems can be used for assuring the attachment of the elements, these systems being able to be, for example, one of the following: screw, self-tapping screw, rivet, bolt, nail, adhesive, pin, etc.

It will be understood that references to geometric position, such as, for example, parallel, perpendicular, tangent, etc., allow deviations of up to ±5° with respect to the theoretical position defined by said nomenclature.

Other features of the invention can be seen in the following detailed description of an embodiment.

BRIEF DESCRIPTION OF THE DRAWINGS

The foregoing and other advantages and features will be better understood from the following detailed description of an embodiment in reference to the attached drawings which must be interpreted in an illustrative and non-limiting manner, in which.

DETAILED DESCRIPTION OF AN EMBODIMENT

Figure 1:
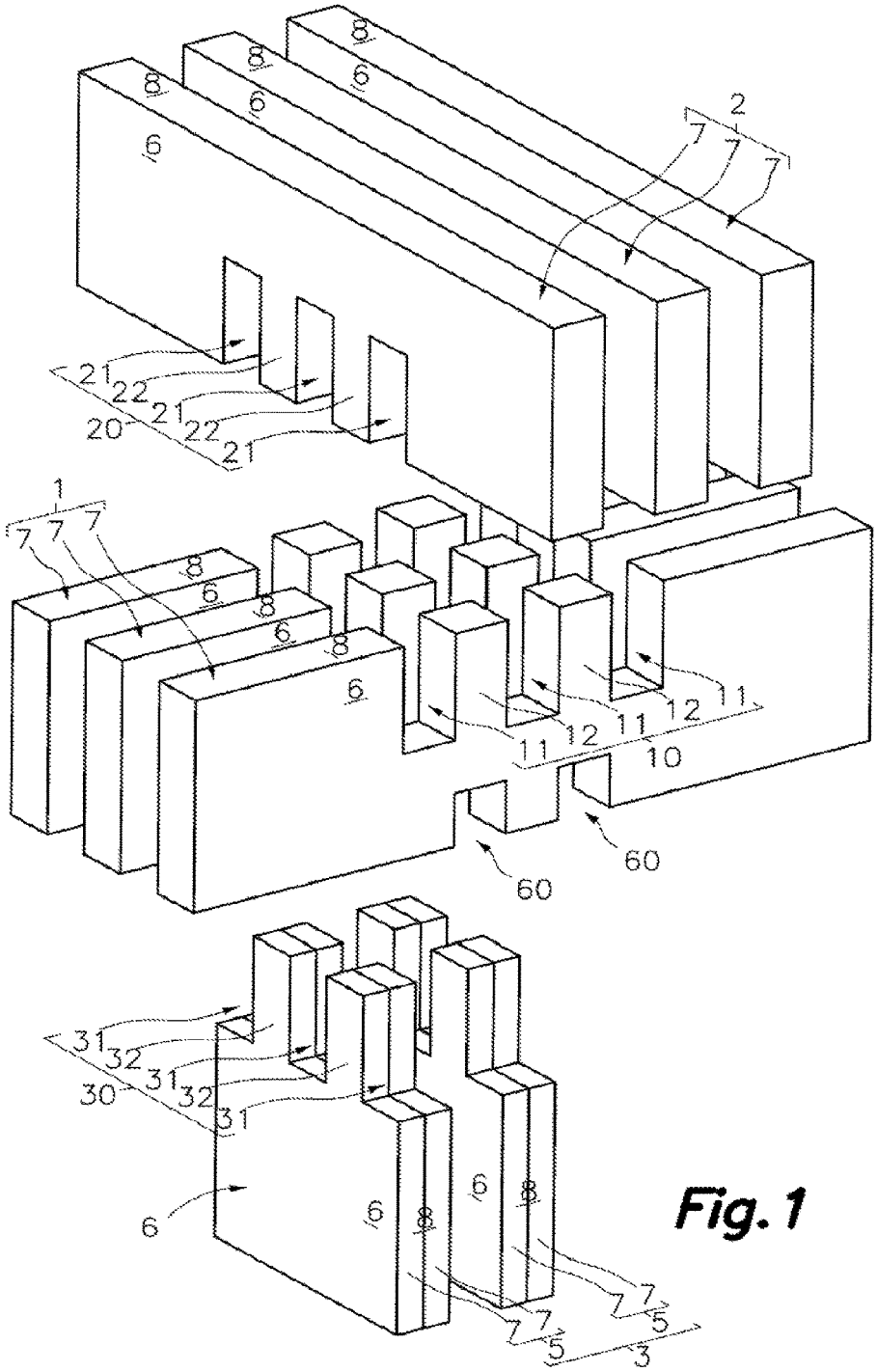
FIG. 1 shows a perspective view of a first structural element, a second structural element, and a third structural element uncoupled from one another, the first structural element being formed by three boards spaced from one another, the second structural element being formed by three boards spaced from one another, and the third structural element being formed by two groups of boards spaced from one another, each group of boards being formed by two boards.

According to the non-limiting embodiment shown in attached FIGS. 1 to 4, a structural node is formed by the mutual coupling of a first structural element 1, a second structural element 2, a third structural element 3 and a fourth structural element 4.

According to this embodiment, the first structural element 1 and the second structural element 2 are each made up of three boards 7 parallel to and spaced from one another, all of them arranged with their main faces 6 in the vertical direction. The third structural element 3 and the fourth structural element 4 (shown in FIGS. 3 and 4) are each made up of two groups of boards 5 parallel to and spaced from one another, each group of boards 5 in turn being formed by two boards 7 arranged with their main faces 6 in contact with one another. The groups of boards are likewise arranged with their main faces 6 in the vertical direction.

The first structural element 1 has a first coupling configuration 10 formed by three first straight slots 11 made in each of the boards 7 forming said first structural element 1 from the their upper side faces 8 to half the width of their main faces 6, the first slots 11 of each board 7 facing and being aligned with the first slots 11 of the other boards 7 forming said first structural element 1. A first projection 12 is defined between each of said first slots 11, the three first slots 11 defining two first projections 12.

In an equivalent manner, the second structural element 2 has a second coupling configuration 20 formed by three second straight slots 21 made in each of the boards 7 forming said second structural element 2, from the lower side faces 8 thereof to half the width of the main faces 6 thereof, the second slots 21 of each board 7 facing and being aligned with the second slots 21 of the other boards 7 forming said second structural element 2. A second projection 22 is defined between each of said second slots 21, the three second slots 21 defining two second projections 22.

The first coupling configuration 10 is complementary to the second coupling configuration 20, the width of the first slots 11 being equal to the width of the boards 7 forming the second structural element 2, and the width of the second slots 21 being equal to the width of the boards 7 forming the first structural element 1. The width of the first projections 12 define the separation distance between the boards 7 of the second structural element 2, and the width of the second projections 22 define the separation between the boards 7 of the first structural element 1.

Figure 2:
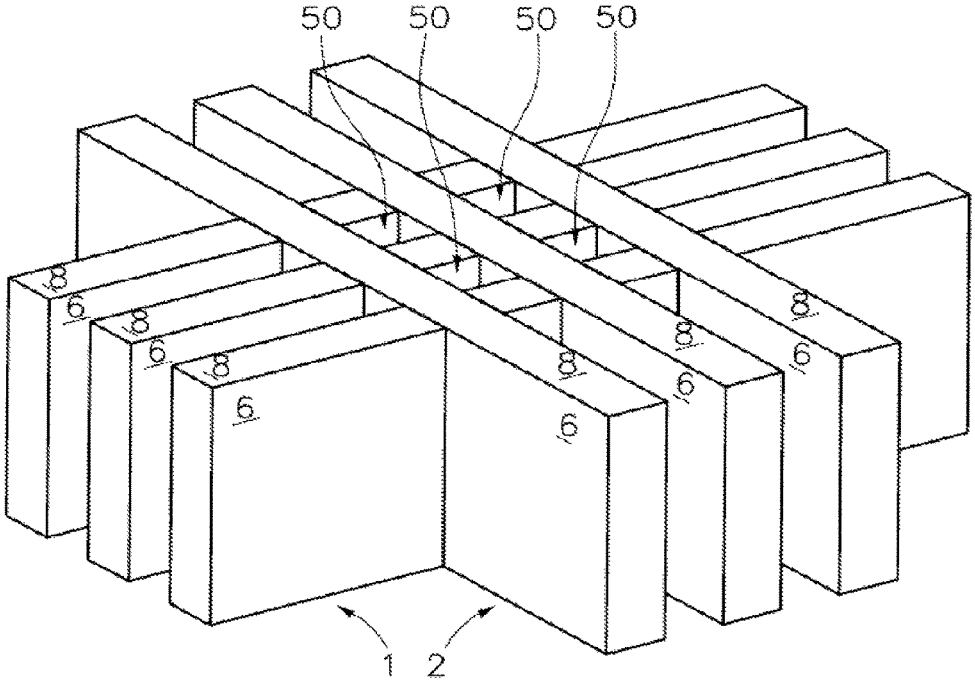
FIG. 2 shows a perspective view of the same structural elements shown in FIG. 1, the first and second structural elements being coupled by means of their corresponding coupling configurations, the intersection of the separations between the boards of the first and second structural elements forming interstitial openings having a size and shape complementary to the third projections integrated in the coupling configuration of the third structural element.
Figure 2:
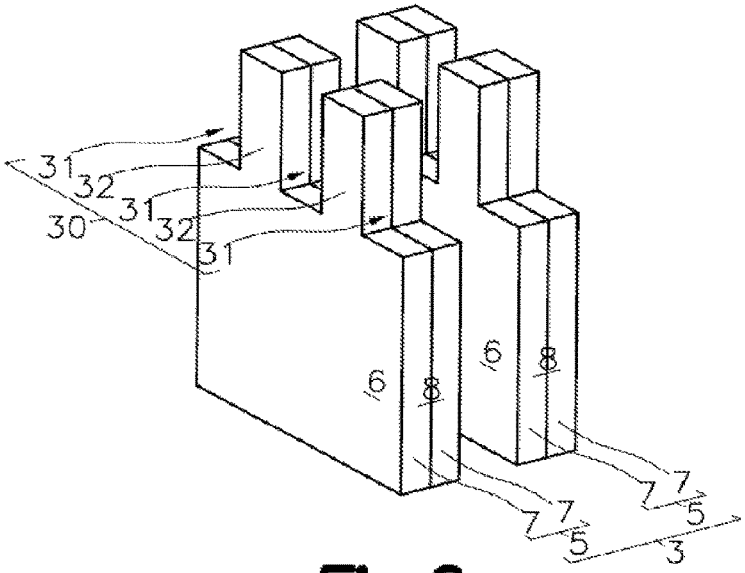
Figure 3:
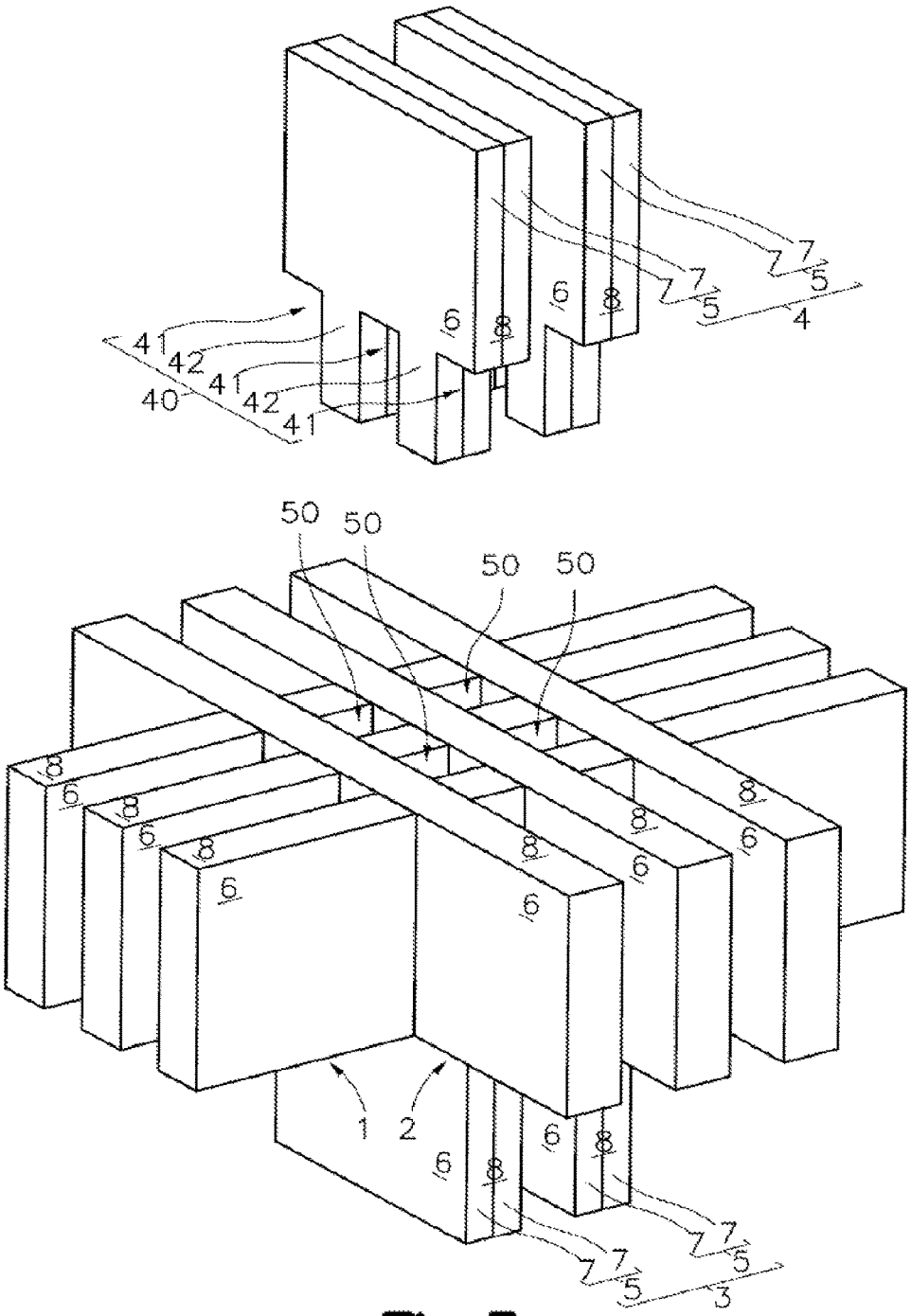
FIG. 3 shows a perspective view of the same structural elements shown in FIG. 2, the third structural element being coupled to the first and second structural elements by means of the insertion of said third projections in said interstitial openings, and also showing a fourth structural element uncoupled from the structural node and located there above.

When the first and second structural elements are coupled as shown in FIG. 2 by means of the mutual insertion of the first and second slots 11 and 21, an array defining interstitial openings 50 is obtained.

In the present embodiment, said interstitial openings 50 are square since the first and second structural elements 1 and 2 are perpendicular, but in another embodiment it is acceptable that both structural elements form with one another an angle other than 90°, creating rhombus-shaped interstitial openings 50 by means of the mutual coupling of first and second slots 11 and 21 going through the thickness of the boards 7 of the first and second structural elements 1 and 2 at said angle other than 90°, said slots therefore not being perpendicular to the main faces 6 of said boards 7.

Likewise, in the present embodiment shown in the attached drawings, both the first and second structural elements 1 and 2 are horizontal, but in alternative embodiments it is contemplated that the first and/or the second structural element 1 and/or 2 form an angle with respect to the horizontal. In such case, the first or second slots 11 or 21 of the first or second structural elements 1 or 2 which are inclined will not be perpendicular to the side faces 8 of the boards 7 of the corresponding structural element.

The third structural element 3 shown in FIGS. 1 and 2 has a third coupling configuration 30 formed by three third straight slots 31 made in each of the boards 7 of the groups of boards 5 forming said third structural element 3 from the upper head faces to a depth of half the width of the main face 6 of the first structural element 1, the third slots 31 of each board 7 facing and being aligned with the third slots 31 of the other boards 7 forming said third structural element 3. A third projection 32 is defined between each of said third slots 31, the three third slots 31 defining two third projections 32, and said third projections 32 having a size and shape complementary to those of the interstitial openings 50 to allow a tight fitting.

Likewise, the fourth structural element 4 has a fourth coupling configuration 40 formed by three fourth straight slots 41 made in each of the boards 7 of the groups of boards 5 forming said fourth structural element 4 from the lower head faces thereof to a depth of half the width of the main face 6 of the first structural element 1, the fourth slots 41 of each board 7 facing and being aligned with the fourth slots 41 of the other boards 7 forming said fourth structural element 4. A fourth projection 42 is defined between each of said fourth slots 41, the three fourth slots 41 defining two fourth projections 42, and said fourth projections 42 having a size and shape complementary to those of the interstitial openings 50 to allow a tight fitting.

Therefore, the third and fourth coupling configurations 30 and 40 are complementary to the array formed by the coupling of the first and second coupling configurations 10 and 20.

In the illustrated embodiment, the third projections 32 are inserted into the interstitial openings 50 from the lower face thereof and to a depth equal to half the width of the main faces 6 of the first structural element 1, an upper half of said interstitial openings 50 being empty to receive the fourth projections 42 of the fourth structural element 4.

In alternative embodiments, the fourth structural element 4 does not exist, the third projections 32 being longer, and the third structural element 3 being able to be inserted from both above and from below the interstitial openings 50.

Figure 4:
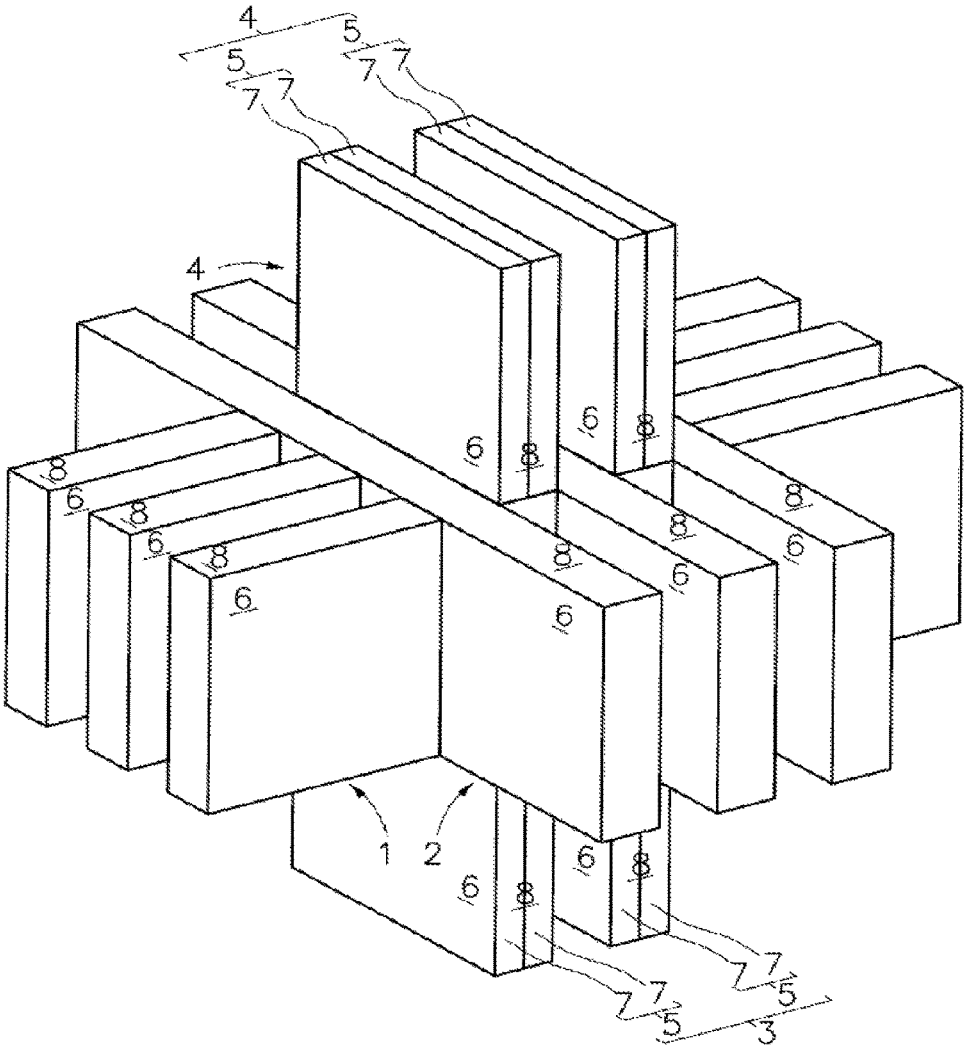
FIG. 4 shows a perspective view of the same structural elements shown in FIG. 3, the fourth structural element being coupled to the first, second and third structural elements by means of the insertion of said fourth projections in said interstitial openings.
Figure 5:
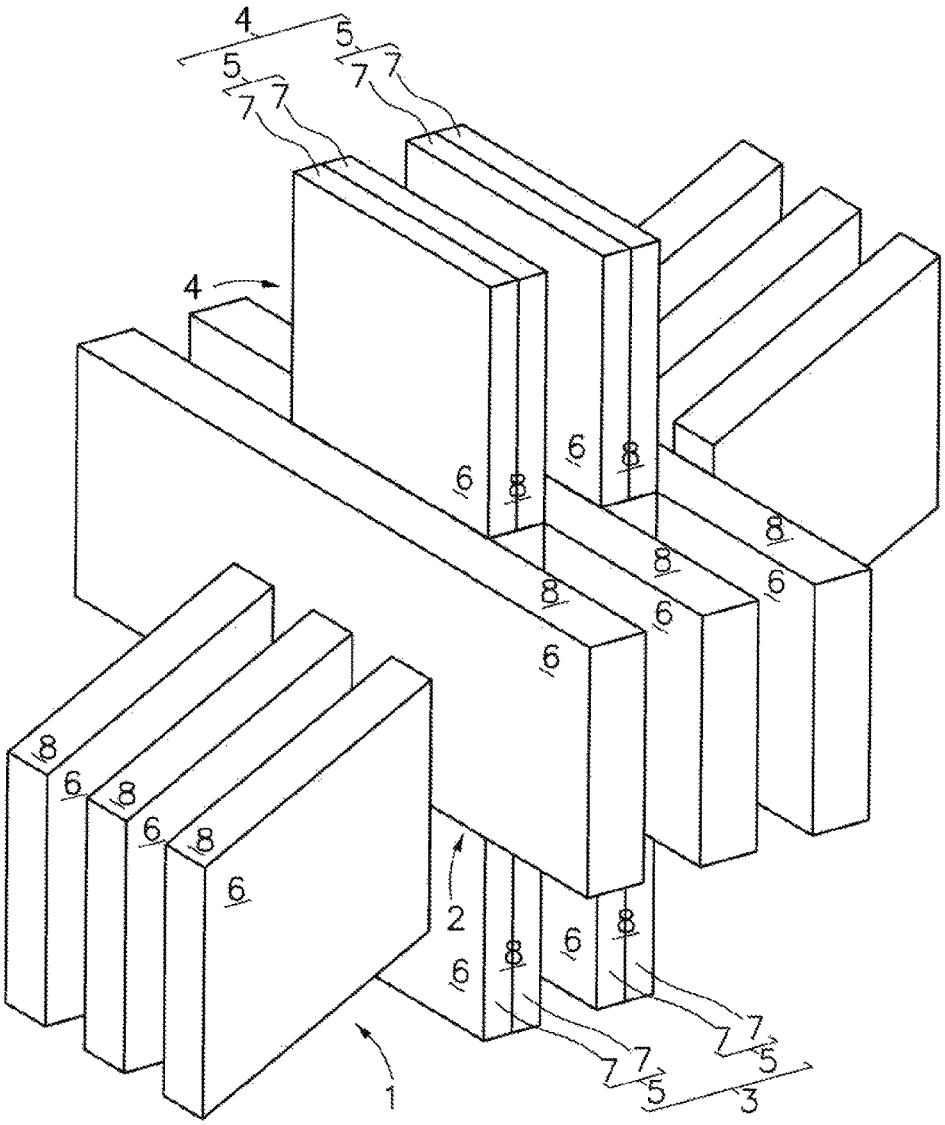
FIG. 5 shows same structural element shown in FIG. 4 but with the first elongated structural element having its longer edges non-horizontal, with an inclination.
Figure 6:
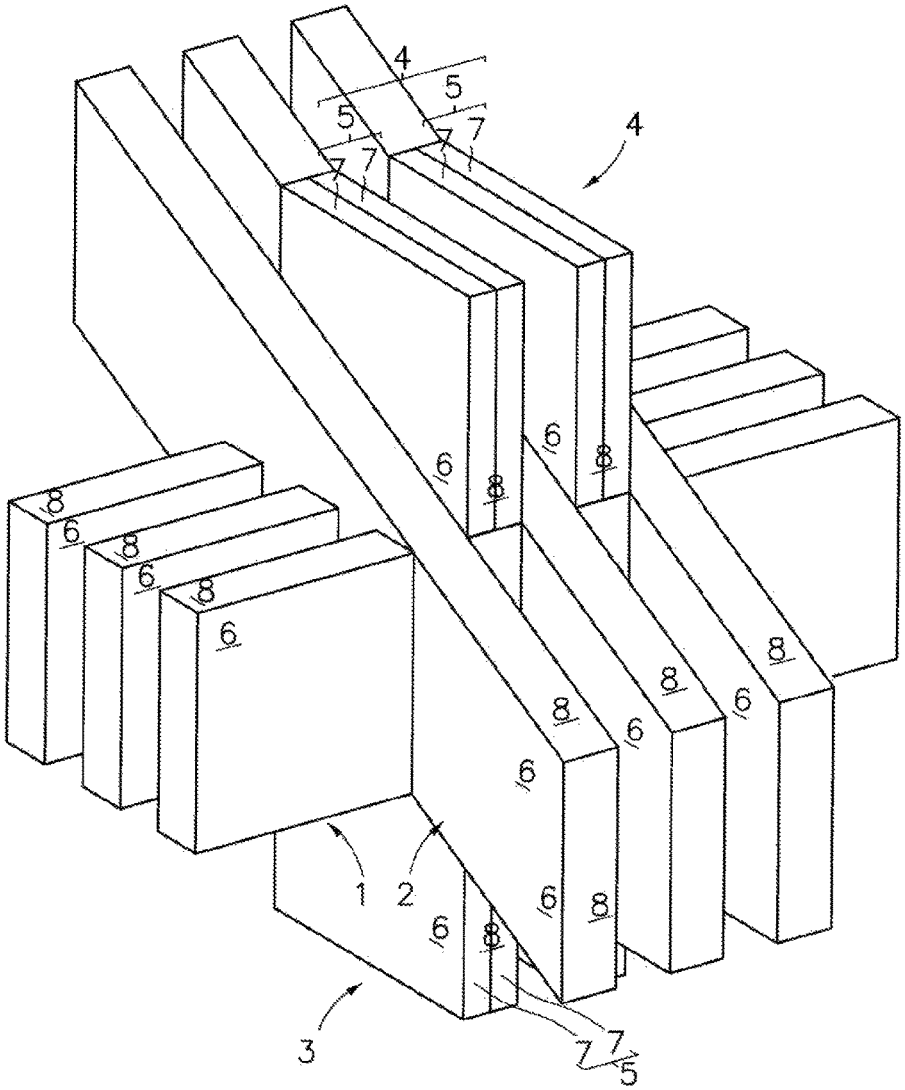
FIG. 6 shows same structural element shown in FIG. 4 but with the second elongated structural element having its longer edges non-horizontal, with an inclination.
Figure 7:
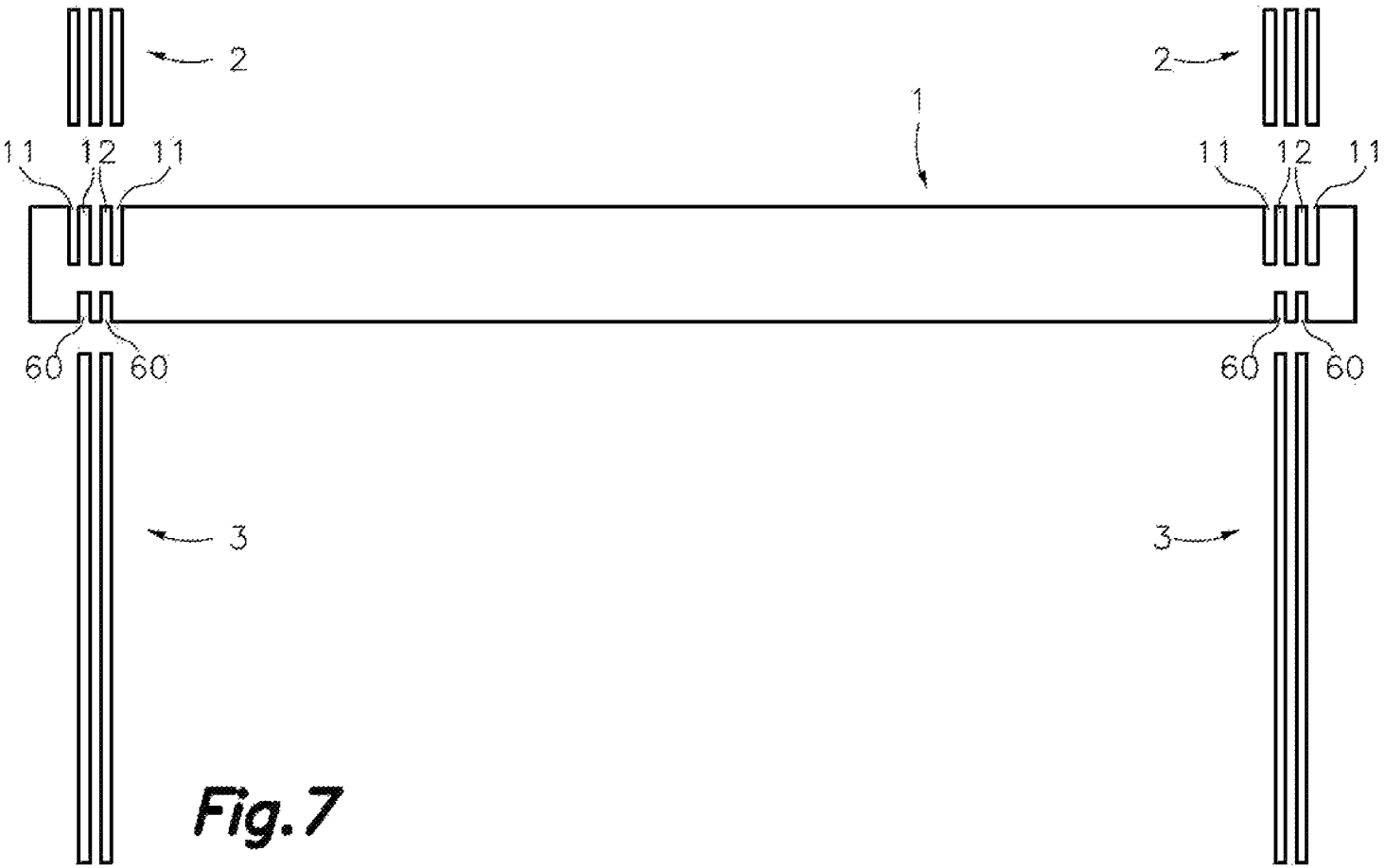
FIG. 7 shows a lateral exploded view of the proposed prefabricated construction system according to an embodiment including one first structural element with two first coupling configurations on opposed ends thereof, and two second and third structural elements.

The proposed three-dimensional structural nodes allow obtaining a rigid attachment of up to four structural elements, the first and second structural elements 1 and 2 being able to be elements passing through said structural node, such that it allows receiving elements from six different sides, like in the example shown in FIG. 4.

FIG. 1 attached hereto shows notches 60 made in the boards 7 of the first structural element 1, said notches 60 being made on the lower side face 8, opposite the upper side face 8 in which the first slots 31 have been made, and said slots 60 being aligned and facing the first projections 12. Said notches 60 allow partial insertion of the third structural element 3, which assures a more resistant structural attachment.

In an alternative embodiment, the distal ends of the first projections 12 can be cut out, being removed with respect to the side face 8, which also works as a notch 60, allowing partial insertion of the fourth structural element 4.

As will be obvious for a skilled person, said notches could be made in the second structural element 2 in an equivalent manner.

The invention claimed is:

1. A prefabricated construction system with three-dimensional structural nodes comprising boards, each board being flat and elongated and having at least two parallel front faces, which are those two faces of the board having the largest surface, two head faces at the ends thereof, which are those two faces of the board being farthest from one another, and two side faces, said faces defining edges of the board, each board being a single board or a group of single boards arranged with the front faces thereof adjacent, matching and in contact, the prefabricated construction system including:

a first elongated structural element formed by a plurality of parallel and spaced boards arranged in an assembled configuration with the front faces thereof in the vertical position arranged parallel to, facing and spaced from one another, said first elongated structural element being arranged with the longer edges thereof being horizontal or with an inclination of ±45° with respect to the horizontal in assembled configuration, and said first structural element being provided with at least a first coupling configuration in at least a lower half or an upper half of said first structural element, the first coupling configuration having a plurality of first straight slots, defining first projections, said first slots extending from a side face of the boards of the first structural element to at least a fifth of the width of the front faces of said first structural element;

a second elongated structural element formed by a plurality of parallel and spaced boards arranged in an assembled configuration with the front faces thereof in the vertical position arranged parallel to, facing and spaced from one another, said second elongated structural element being arranged with the longer edges thereof being horizontal or with an inclination of ±45° with respect to the horizontal in assembled configuration, and said second structural element being provided with at least a second coupling configuration in at least a lower half or an upper half of said second structural element opposite the half where the first coupling configuration is housed, said second coupling configuration in the assembly position being coupled to said first coupling configuration of the first structural element, the second coupling configuration having a plurality of second straight slots, defining second projections, said second slots being complementary to the first slots and extending from a side face of the boards of the second structural element to at least a fifth of the width of the front faces of the second structural element;

a third structural element formed by a plurality of parallel and spaced boards the front faces thereof being in vertical position arranged parallel to, facing and spaced from one another, said third structural element being arranged in the assembled configuration with the longer edges thereof being vertical in assembled configuration, said third structural element being provided with at least a third coupling configuration, which has a plurality of third straight slots, defining third projections, said third slots extending from the head face of the boards of the third structural element to a depth of at least a fifth of the width of the front faces of the first structural element;

the first and second structural elements being non-parallel, the coupling of the first structural element and the second structural element forming an array leaving free interstitial openings vertically going through the structural node formed by the attachment of the first and second structural elements, said third projections in the assembled configuration being inserted into said interstitial openings of the structural node forming a resistant structural node; and the structural elements in assembled configuration forming a frame on which a vertical and a horizontal enclosures can be fixed.

2. The construction system according to claim 1 wherein the construction system includes at least one of the following features:

the number of first slots of the first coupling configuration is equal to the number of boards of the second structural element;

the number of second slots of the second coupling configuration is equal to the number of boards of the first structural element;

the width of the first slots is equal to the thickness of the boards of the second structural element;

the width of the second slots is equal to the thickness of the boards of the first structural element;

the first projections have a width equal to the separation distance between the boards of the second structural element;

the second projections have a width equal to the separation distance between the boards of the first structural element;

the width of the third slots is equal to the thickness of the boards of the first or second structural element;

the third coupling configuration has a number of third slots equal to the number of boards of the first or second structural element;

the third projections have a width equal to the separation distance between the boards of the first or second structural element.

3. The construction system according to claim 1 wherein the number of boards forming the third structural element is equal to the number of boards and/or groups of boards forming the first or second structural element plus one or minus one.

4. The construction system according to claim 1 including:

a fourth structural element arranged in the assembled configuration with the longer edges thereof being vertical, said fourth structural element being formed by at least a plurality of parallel boards arranged in the assembly position with the front faces thereof in the vertical position arranged parallel to, facing and spaced from one another;

and wherein:

the fourth structural element is provided with at least a fourth coupling configuration, which has a plurality of fourth straight slots, defining fourth projections, said fourth slots extending from the head side of the boards of the fourth structural element to a depth of at least a fifth of the width of the front faces of the boards of the first structural element, said fourth projections in the assembled configuration being inserted into said interstitial openings of the structural node, formed by the coupling of the first and second structural elements, said insertion being produced from a face of the node opposite the face of the node in which the third projections of the third structural element are inserted, being the third and the fourth structural elements aligned.

5. The construction system according to claim 4, wherein the system includes at least one of the following features:

the width of the fourth slots is equal to the thickness of the boards of the first or second structural element;

the fourth coupling configuration has a number of fourth slots equal to the number of boards (7) of the first or second structural element;

the fourth projections have a width equal to the separation distance between the boards (7) of the first or second structural element.

6. The construction system according to claim 1 wherein the first or second structural elements, the boards of which are not parallel to the boards of the third structural element, have a plurality of straight notches arranged in a side face of the boards, said notches being made in a side face opposite the side face containing the mentioned first or second projections and vertically aligned with said first and second projections, or made at the ends of the first or second projections of the first or second structural element, said notches being complementary to the third slots or fourth slots.

7. The construction system according to claim 6, wherein the system includes at least one of the following features:

the number of notches is equal to the number of parallel and spaced boards of the third structural element or of the fourth structural element;

the thickness of the notches is equal to the thickness of the boards of the third structural element or of the fourth structural element;

the separation distance between the notches is equal to the separation distance between the boards of the third structural element or of the fourth structural element.

8. The construction system according to claim 1 wherein each structural element has at least two coupling configurations arranged at the ends thereof.

9. The construction system according to claim 1 wherein the first structural element and the second structural element in the mounting position are flush along the upper face thereof.

10. The construction system according to claim 1 wherein each board has been cut by means of a cutting system with numerical control.

11. The construction system according to claim 10, wherein each board includes information that is engraved, cut or printed on the surface thereof during cutting tasks, in reference to the position or placement thereof, or in reference to the position or placement of other construction elements with respect to said board.

12. The construction system according to claim 1 wherein the material used in the boards is one of the following: wood, plywood, agglomerated wood, resins, resins and paper.

* * * * *